US006237692B1

(12) United States Patent
Averhoff

(10) Patent No.: US 6,237,692 B1
(45) **Date of Patent: *May 29, 2001**

(54) GAS DISPLACED CHAMBER LIFT SYSTEM HAVING A DOUBLE CHAMBER

(75) Inventor: Jon R. Averhoff, Houston, TX (US)

(73) Assignee: Valence Operating Company, Kingwood, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/339,482

(22) Filed: Jun. 24, 1999

Related U.S. Application Data

(63) Continuation-in-part of application No. 09/201,017, filed on Nov. 30, 1998, now Pat. No. 6,021,849.

(51) Int. Cl.[7] ..... E21B 43/00

(52) U.S. Cl. ..... 166/372; 166/105

(58) Field of Search ..... 166/372, 105, 166/105.6; 92/37, 30; 417/120; 60/370

(56) References Cited

U.S. PATENT DOCUMENTS

| | | | |
|---|---|---|---|
| 3,617,152 | | 11/1971 | Cummings . |
| 4,589,494 | | 5/1986 | Sakoda . |
| 4,708,595 | | 11/1987 | Maloney et al. . |
| 5,141,412 | | 8/1992 | Meinz . |
| 5,211,242 | | 5/1993 | Coleman et al. . |
| 5,217,067 | | 6/1993 | Landry et al. . |
| 5,407,010 | | 4/1995 | Hershberger . |
| 5,542,472 | | 8/1996 | Pringle et al. . |
| 5,562,161 | | 10/1996 | Hisaw et al. . |
| 5,671,813 | | 9/1997 | Lima . |
| 5,806,598 | | 9/1998 | Amani . |
| 6,021,849 | * | 2/2000 | Averhoff ..... 166/372 |

FOREIGN PATENT DOCUMENTS

| | | |
|---|---|---|
| 23 64 737 | 7/1975 | (DE) . |
| 570-697 | 9/1977 | (SU) . |
| 1204 -700 | 1/1986 | (SU) . |

OTHER PUBLICATIONS

The Technology of Artificial Lift Methods. vol. 2a pp. 124–132.

Otis Single and Dual–Acting Gas Pumps: To Enhance Artificial Lift Production for Light and Heavy Crude in Shallow and Deep Wells. Otis Engineering sales brochure.

* cited by examiner

*Primary Examiner*—David Bagnell
*Assistant Examiner*—John Kreck
(74) *Attorney, Agent, or Firm*—Harrison & Egbert

(57) ABSTRACT

An artificial lift system for use in a well bore having a first chamber with an inlet and an outlet, a second chamber having an inlet and an outlet and arranged in spaced and separate side-by-side parallel relationship to the first chamber, a power gas string connected to the first and second chambers, a liquid string connected to the outlet of the first chamber and to the outlet of the second chamber, a vent connected to the first and second chambers, a compressor connected to the power gas string and adapted to pass a pressurized gas into the power gas string, and a valve connected to the power gas string and to the vent. The valve is adapted to selectively and alternately pass pressurized gas into the first and second chambers so as to cause liquid in the first and second chambers to pass through the respective outlets and into the liquid string. The valve is adapted to selectively and alternately vent gas from the first and second chambers after the liquid has passed into the liquid string.

17 Claims, 3 Drawing Sheets

GAS DISPLACED CHAMBER LIFT SYSTEM HAVING A DOUBLE CHAMBER

RELATED APPLICATIONS

The present application is a continuation-in-part of U.S. application Ser. No. 09/201,017, filed on Nov. 30, 1998, and entitled "Gas Displaced Chamber Lift System", now U.S. Pat. No. 6,021,849. The present invention further relates to lift systems employing double chambers for the collection of liquid from the wellbore.

TECHNICAL FIELD

The present invention relates to artificial lift systems. More particularly, the present invention relates to chamber lift systems which are used so as to deliver oil, water and gas from a wellbore to a surface above the wellbore. More particularly, the present invention relates to gas-displaced chamber lift systems.

BACKGROUND ART

At the present time, it is common to permit oil and gas wells to flow under their own natural pressure as long as they will do so and then to apply a mechanical reciprocating pump to complete the removal of the liquids. This method, although in general use, is cumbersome and unsatisfactory. Because suction will only raise oil for a distance of some thirty-five feet, it is necessary to have the pump near the bottom of the well so that it can exert pressure instead of suction on the liquids coming out of the well. This involves the use of pump rods of lengths of 5,000 feet or greater. In many instances when the pump plunger or the valves become worn, it is necessary to remove the pump from that depth to replace the worn parts. Furthermore, the collars on the pump rod wear rapidly and all the pump parts do likewise because of the small particles of grit that remain in the liquid and the whole device is mechanically inefficient because of the relatively long pump rods that must be reciprocated to perform the pumping operation.

When the natural flow of liquid from a well has ceased or becomes too slow for economical production, artificial production methods are employed. In many cases, it is advantageous, at least during the first part of the artificial production period, to employ gas lift. Numerous types of equipment for producing liquid by gas lift are available, but they all rely upon the same general principles of operation. In the usual case, dry gas consisting essentially of methane and ethane is forced down the annulus between the tubing and the casing and into the liquid in the tubing. As the liquid in the tubing becomes mixed with gas, the density of the liquid decreases, and eventually the weight of the column of the gasified liquid in the tubing becomes less than the pressure exerted on the body of liquid in the well, and the flow of liquid occurs at the surface. While, in some cases, the dry gas may be introduced through the tubing so as to cause production through the annulus, this is not preferred unless special conditions are present.

One known gas lift technique injects gas into the casing, which has been sealed or packed off at the bottom of the hole relative to the production tubing. A gas lift valve is placed in the production tubing at the production level, and the gas lift valve permits the gas to be injected into or bubbled very slowly into the liquid being produced from the well. This gas then makes the liquid in the production tube somewhat lighter and, hence, the natural formation pressure will be sufficient to push the liquid up and out of the well. This means that the well can be produced at a greater rate. This gas lift technique is known as continuous gas lift.

A further adaptation of this gas lift technique is known as intermittent gas lift. In this technique, rather than letting the gas enter the production tube slowly, the gas is injected into the production tubing very quickly, in short bursts, thereby forming a large slug of liquid in the production tubing above the injected gas bubble. The gas bubble then drives the slug of liquid in the production tubing upwardly. The technique is repeated successively, thereby producing successive slugs of liquid at the wellhead.

Another type of gas lift tool involves a procedure where a string of production tubing extending from the surface to the zone of interest is provided with a number of gas lift valves positioned at spaced intervals along the length of the tubing. Gas is injected from the annulus between the tubing and the well pipe through the gas lift valves and into the tubing for the purpose of forcing liquid upwardly to the surface and ultimately into a flowline that is connected with the production tubing. Gas lift systems for liquid production are quite expensive due to the cumulative expense of the number of gas lift valves that are ordinarily necessary for each well. Moreover, each of the gas lift valves must be preset for operation at differing pressures because of the vertical spacing thereof within the tubing string and because the valves must function in an interrelated manner to achieve lifting of liquid within the tubing string.

In the past, various patents have issued relating to such gas lift systems. For example, U.S. Pat. No. 5,671,813, issued on Sep. 30, 1997 to P. C. Lima describes a method and apparatus for the intermittent production of oil. In this method, two production strings extend downwardly from a wellhead of an oil well to a point adjacent a producing region. The lower ends of the two production strings are connected by a coupling which allows a mechanical interface launched adjacent the wellhead of one of the production strings to descend along the production string through the coupling and upwardly through the other production string to displace oil from the production strings to a surge tank. High pressure gas is utilized to move the mechanical interface through the production strings and suitable valves are provided for controlling the flow of gas and oil through the production strings.

U.S. Pat. No. 5,562,161, issued on Oct. 8, 1996 to Hisaw et al. describes a method of accelerating production from a well. This method includes the steps of installing a venturi device within the well. A gas is injected within the annulus and introduced into the well. The venturi device creates a zone of low pressure within the well as well as accelerating the velocity of the production fluid so that the inflow from the reservoir is increased.

U.S. Pat. No. 5,407,010, issued on Apr. 18, 1995 to M. D. Herschberger teaches an artificial lift system and method for lifting fluids from an underground formation. This artificial lift system includes a production tubing through which the fluid is carried from the formation to the surface and a pressure reducer, such as a venturi, connected to the production tubing to artificially raise the level of the fluid in the production tubing above the static level associated with the head pressure of the fluid in the formation.

U.S. Pat. No. 5,217,067, issued on Jun. 8, 1993 to Landry et al. describes an apparatus for increasing flow in an oil well which includes an injection valve so as to enable gas to be injected and to cause the oil or other liquid within the well to be lifted to the surface. The valve has a valve body having an inlet at one end and an outlet at the other end which are adapted to be fitted into conventional production oil tubing. A gas injection port opens into the outlet of the valve body and there is at least one gas inlet opening in a side of the valve body. This gas inlet opening is connected to the gas injection port. This enables compressed gas to be sent down the well between the casing and the tubing and injected through the gas injection port and into the flow of oil.

U.S. Pat. No. 5,211,242, issued on May 18, 1993 to Coleman et al. describes a chamber in a well which is connected to two externally separate tubing strings to unload liquid which is applying backpressure against a formation so that the production of fluid from the formation is obstructed. Volumes of the liquid are intermittently collected in the chamber and lifted out of the well through one of the tubing strings in response to high pressure gas injected solely into the chamber through the other tubing string.

U.S. Pat. No. 4,708,595, issued on Nov. 24, 1987 to Maloney et al. describes an intermittent gas-lift apparatus and process of lifting liquids. This apparatus includes a chamber on the downhole end of a production tubing in communication with a sidestring tube. The sidestring tube is in communication with the high pressure gas stored within the casing and above and below a packer. A valve in the sidestring tube permits the entrance of a lifting gas into the chamber to lift the liquids flowing therein to the surface. A surface bleed-down system minimizes the pressure in the production tubing. This increases the pressure differential between the formation and the interior of the casing and lifting chamber during the operation of the apparatus.

German Patent No. 23 64 737, published on Jul. 10, 1975, teaches a compressed air lift pump for deep wells in which the pump has a number of stages one above the other. Liquid is raised by air from the reservoir of one stage to the reservoir of the next. Each stage has two air supply pipes which contain three-way valves operated by an electronic timer to admit and release air alternately.

Soviet Patent No. 1204-700-A teaches an intermittent gas lift system for a pump well which includes a tubing, a packer, a substitution chamber and intake valve, lift starter valves and working valves with a seal and a seat over a space connected to the chamber. The rising level of fluid in the chamber raises the float so as to close off ports and thus raise pressure above the diaphragm so as to clear the valve and transfer gas to the chamber. This gas forces the fluid into the tubing and uses a pressure gradient to hold the ports closed. Gas eventually enters the tubing after all fluid has been expelled, thus opening the two ports by lowering the float back down. Gas is removed entirely from the chamber by the incoming fluid.

Soviet Patent No. 570697 teaches an oil production facility including a displacement chamber, two strings of compressor pipes of which one is coupled to the surface drive. The gas from the chamber is recuperated and expanded. When one vessel is empty, fluid is drawn into the displacement chamber. The second vessel pumps oil over into the empty vessel so as to raise its pressure to the point required to drive the hole fluid over into the lifting string to the surface. Once the fluid in the chamber reaches the bottom of the lift string, the motor reverses so as to turn an electric shaft and compress the gas in the first vessel to repeat the process in a second hole.

A major problem with the aforedescribed artificial lift systems is that they do not work effectively in deep well and sour gas environments. In particular, at depths of greater than 10,000 feet, the temperature range encountered can be approximately 300 degrees Fahrenheit. As such, any mechanical pumping apparatus will not work effectively at such temperatures. At such great depths, the rod pump devices and submersible pump apparatus do not effectively deliver oil and gas to the surface. For example, at such great depths, the pump rod will have an extreme length which cannot be easily reciprocated back and forth. Furthermore, the cost associated with such a lengthy pump rod would not allow for efficient production. The high temperature and pressures encountered at such depth cause submersible pumps and hydraulic pumps to fail quickly.

In those systems in which the intermittent production of "slugs" of oil is utilized, such systems are ineffective at such depths. In each case in which a "slug" of oil is produced, the gas must be relied upon so as to deliver such a slug to the surface. At great depths, this can take a great deal of time so as to produce an economical amount of oil. Furthermore, the pressure and energy required so as to push such a slug to the surface may exceed the value of the actual production.

Production at such a depth is further complicated by situations in which a corrosive sour gas is encountered. This is particularly true in those cases in which oil and gas must be removed from Smackover wells.

U.S. patent application Ser. No. 09/201,017, filed on Nov. 30, 1998, to the present applicant, describes the original form of the gas displaced chamber lift system. After experimentation, study and analysis, it was found that it was important to have a gas displaced chamber lift system that operated in a relatively continuous mode. In the single chamber gas displaced chamber lift system, liquid would accumulate in the single chamber. After sufficient liquid had accumulated in the chamber, then the valve would open so as to cause the pressurized gas to pass through the power gas string with sufficient pressure so as to evacuate the chamber of the liquid and to pass the liquid from the outlet of the chamber into the liquid string. After the liquid would pass to the liquid string, the pressurized gas from the power gas string would be blocked and the remaining gas within the chamber would be vented to the surface. It was found that during the process of evacuating the chamber and during the process of venting the gas, there was a period of time in which production ceased. It was found to be desirable to allow production (i.e. the accumulation of liquid in the chamber) to continue during the evacuation and venting process. As such, a double chamber approach was devised and disclosed in this prior application. Parent patent application Ser. No. 09/201,017 described a double chamber approach in which one of the chambers was stacked on top of the other chamber or in which one chamber was located interior of and in concentric relationship with the other chamber. After experimentation and analysis, it was found that such an arrangement was difficult to configure within the well bore. Additionally, the stacked arrangements could occasionally produce varying quantities of liquid within the respective chambers due to the head pressure within the well.

It is an object of the present invention to provide an artificial lift system which works effectively at depths of greater than 10,000 feet.

It is a further object of the present invention to provide an artificial lift system which can operate in a high temperature environment at the bottom of the well.

It is another object of the present invention to provide an artificial lift system in which production from the liquid string occurs continuously without the need for transporting a "slug" of oil to the surface.

It is another object of the present invention to provide an artificial lift system which works effectively in highly corrosive sour gas environments.

It is another object of the present invention to provide an artificial lift system which can lift liquid volumes of approximately 500 barrels per day.

It is a further object of the present invention to provide an artificial lift system which can operate in a very "gassy"/ high API oil gravity environment.

It is still a further object of the present invention to provide an artificial lift system which can handle saturated brines of greater than 200,000 parts per million.

It is still another object of the present invention to provide a double chamber gas displaced chamber lift system in which at least one chamber is continuously available for the accumulation of liquid therein.

It is a further object of the present invention to provide a double chamber gas displaced chamber lift system in which the chambers can be alternately evacuated and vented without interrupting production capacity.

It is still a further object of the present invention to provide a double chamber gas displaced chamber lift system which is easy to configure and easy to install within the well bore and which is not subject to varying head pressures within the well bore.

These and other objects of the present invention will become apparent from a reading of the attached specification and appended claims.

SUMMARY OF THE INVENTION

The present invention is an artificial lift system for use in the lifting of a liquid from a well bore. The artificial lift system of the present invention comprises a first chamber having an inlet and an outlet, a second chamber having an inlet and an outlet and arranged in spaced and separate side-by-side parallel relationship to the first chamber, a power gas string connected to the first and second chambers, a liquid string connected to the outlet of the first chamber and with the outlet of the second chamber, a vent connected to the first and second chambers, a compressor connected to the power gas string and adapted to pass a pressurized gas into the power gas string, and a valve connected to the power gas string and to the vent. The valve is adapted to selectively and alternately pass pressurized gas into the first and second chambers so as to cause liquid in the first and second chambers to pass through the respective outlets and into the liquid string. The valve is adapted to selectively and alternately vent gas from the first and second chambers after the liquid has passed into the liquid string.

The liquid extends continuously along the liquid string from the uppermost of the outlets of the first and second chambers. The first and second chambers have approximately equal volumes. The first chamber has a top end aligned in a horizontal plane with the top of the second chamber. The first chamber also has a bottom end aligned in a horizontal plane with the bottom of the second chamber.

The valve is movable between a first position and a second position. The first position allows pressurized gas to enter the first chamber while blocking pressurized gas from entering the second chamber. The second position allows pressurized gas to enter the second chamber while blocking pressurized gas from entering the first chamber.

The vent is interactive with the valve so as to allow gas to vent from the first chamber after the liquid is passed from the first chamber. The vent is also interactive with the valve so as to allow gas to vent from the second chamber after the liquid has passed from the second chamber into the liquid string. The valve is adapted to close the vent relative to the first chamber when the valve is moved to the first position. The valve is adapted to close the vent to the second chamber when the valve is moved to the second position. In the present invention, the compressor is adapted to pass a pressurized gas of greater than 5,000 p.s.i. into the power gas string.

The present invention is also a method of lifting a liquid from a well bore including the steps of: (1) passing pressurized gas through the power gas string into the first chamber so as to force liquid from the first chamber into the liquid string; (2) blocking gas flow from entering the second chamber so as to allow liquid to accumulate in the second chamber; (3) venting gas from the first chamber after a desired period of time; and (4) passing pressurized gas through the power gas string into the second chamber and blocking the passing of pressurized gas into the first chamber so as to cause liquid to exit the second chamber and to enter the liquid string as a continuous liquid line through the liquid string. The pressurized gas is vented from the second chamber after a desired period of time.

DETAILED DESCRIPTION OF THE PRESENT INVENTION

Figure 1:
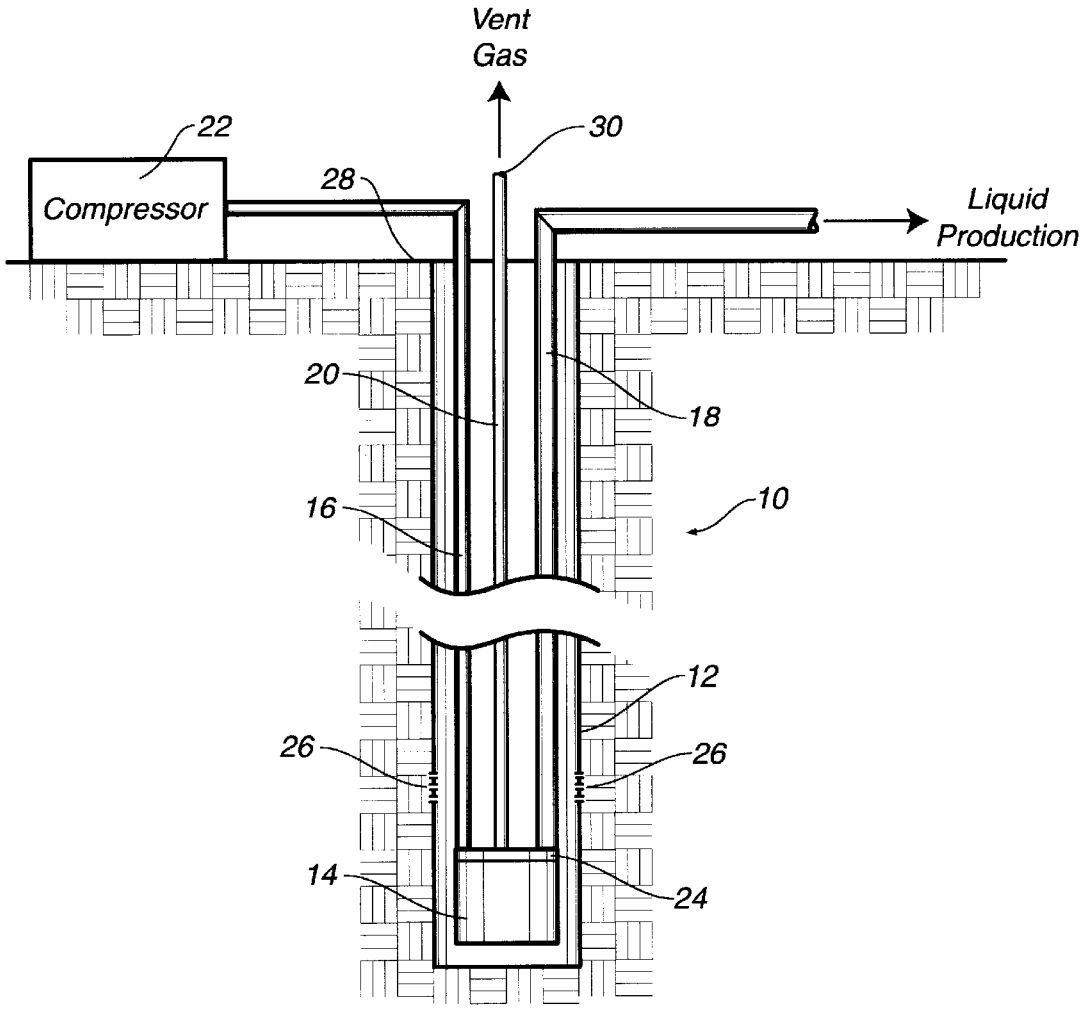
FIG. 1 is a diagrammatic cross-sectional view showing the configuration of the artificial lift system of the present invention.

Referring to FIG. 1, there is shown diagrammatically at 10 the artificial lift system in accordance with the teachings of the present invention. The artificial lift system 10 is used for the extraction of oil, water and gas from the wellbore 12. The artificial lift system 10 includes a chamber 14, a power gas string 16, a liquid string 18, a vent stack 20 and a compressor 22. A suitable valving mechanism 24 is provided in association with the chamber 14. The valving mechanism 24 will be described in greater detail in connection with the illustrations of FIGS. 2 and 3.

As can be seen in FIG. 1, the chamber 14 is located in the wellbore 12 below perforations 26 that are formed in the wellbore 12. The chamber 14 could also be positioned above the perforations in the wellbore. The perforations 26 can be associated with perforations that are formed in an existing casing or in an existing production tubing. The power gas string 16 will extend from the compressor 22 to the chamber 14. The valving mechanism 24 is interactively connected with the power gas string 16 so as to allow pressurized gas to enter the chamber and to cause any liquid in the chamber 14 to pass through an outlet in the chamber and into the liquid string 18. Any liquids within the chamber 14 will enter the liquid string 18 in a continuous flow line along the liquid string 18. The liquid string 18 extends from the chamber 14 to the wellhead area 28. As such, liquid, such as oil, can be removed from the wellbore 12. Vent stack 20 is illustrated as extending from the chamber 14. The vent stack should have a suitable height so that the outlet 30 of the vent stack 20 resides in a location above the perforations 26. The vent stack 20 does not have to extend to an above-earth location, as illustrated in FIG. 1.

In FIG. 1, the compressor 22 should be a compressor which can produce at least 5,000 p.s.i. of gas pressure. This relatively large amount of gas pressure is required so as to push the entire line of liquid from the chamber 14 in a continuous line through the liquid string 18. The valving mechanisms and the associated tubing should have a suitable integrity to withstand such pressure.

Importantly, in the present invention, the power gas string 16 and the liquid string 18 can be formed of coiled tubing. Such coiled tubing can be run in and pulled from the well together as siamese strings. This provides an enormous efficiency in the installation and removal of such power gas and liquid strings.

Figure 2:
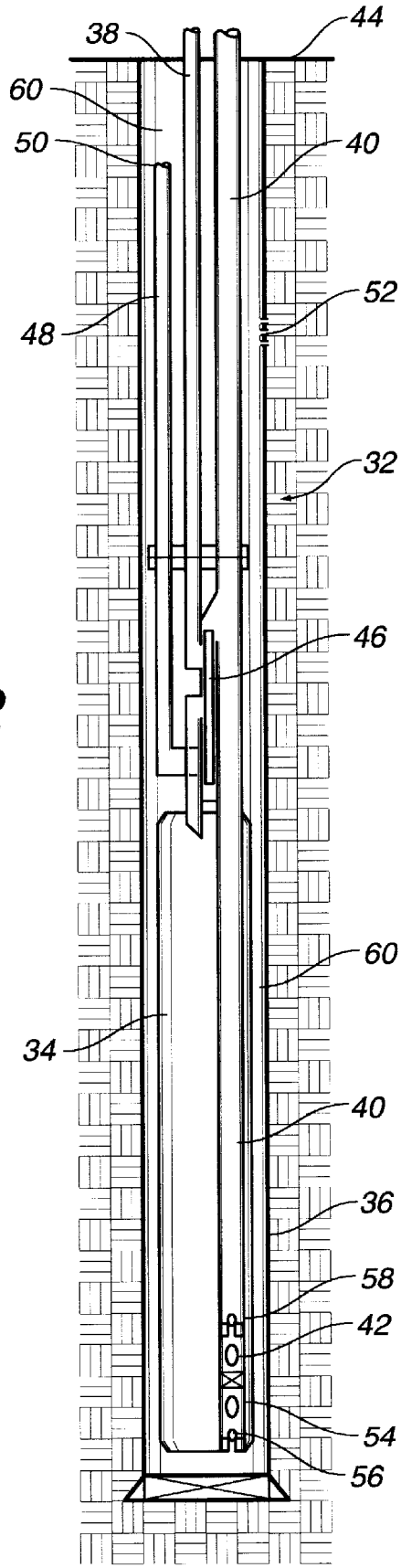
FIG. 2 is a diagrammatic illustration of a single chamber gas displaced chamber lift system in accordance with the simplest embodiment of the present invention.

Referring to FIG. 2, there is illustrated a simplified form of the present invention which is a single chamber gas displaced chamber lift system 32. In this form of the present invention, a chamber 34 is placed within the wellbore 36. A power gas string 38 extends through the wellbore 36 and communicates, in valved communication, with the interior of the chamber 34. A liquid string 40 is connected to an outlet 42 of the chamber 34. The liquid string 40 will extend through the wellbore 36 and exit at the wellhead 44. A shifting valve 46 is provided so as to control the interaction of the chamber 34 with the power gas string 38 and with the vent stack 48. As can be seen in FIG. 2, the vent stack 48 is a tubing which extends so as to have an outlet 50 located above the perforations 52 in the wellbore 36. The valve 46 is a shifting valve in a side pocket mandrel with a side string connection. A valve 46 serves to shift the power gas so as to deliver the power gas into the interior of the chamber 34 when the pressure in the power gas string reaches an upper level. The shifting valve 46 serves to block the delivery of power gas from the power gas string 38 to the chamber 34 and to open the vent stack 48 when the pressure in the power gas string 38 reaches a lower level. The monitoring of the pressure in the power gas string 38 and the operation of the valve 46 can be carried out with suitable sensors and actuators.

As can be seen in FIG. 2, the chamber 34 includes an inlet 54 which allows fluids from the subsurface earth formation to enter the interior of chamber 34. The inlet 54 includes a check valve 56 which is configured so that the fluids will flow into the interior of chamber 34 but will not exit the interior of chamber 34 through the valve 56. Any flow of liquid into the interior of chamber 34 will displace the check valve 56. When the pressurized gas enters the interior of the chamber 34, the check valve 56 will move to its seated location so as to prevent any loss of fluids through the inlet 54.

The outlet 42 also includes a check valve 58. The outlet 42 will allow any fluids on the interior of chamber 34 to exit the chamber 34 when the power gas is delivered from the power gas string 38 into the interior of chamber 34. The power gas will force the fluid from the interior of chamber 34 through the outlet 42, through the check valve 58 and into the liquid string 40. This flow will displace the check valve 58 during the exiting of fluid from the chamber 34. The check valve 58 will become seated when the flow of pressurized gas is blocked from entering the chamber 34. The weight of the liquid column within the liquid string 40 will force the check valve 58 into its seated relationship therewith and to prevent the liquid from reentering the chamber 34.

In operation, the method of the present invention begins with the chamber 34 being full of liquid. The valve 46 communicates with the top of the chamber 34 with the casing annulus 60 at a point above the perforations 52. Simultaneous with this, the compressor 22 at the surface is injecting gas into the power gas string 38. The gas injected in the power gas string 38 increases the pressure in the power gas string since the shifting valve 46 has the power gas string 38 blocked downhole.

At a calculated preset power gas string pressure, the shifting valve 46 closes the port of the vent stack 48 and opens the top of the chamber 34 to the power gas string 38. In this case, the switching occurs when the power gas string pressure at the shifting valve 46 increases to an upper level of pressure. This upper pressure setting is calculated such that the power gas string 38 will "store" the correct volume of power gas to displace the interior of the chamber 34. The power gas begins to enter the chamber 34 and push ("displace") the liquid out of the chamber 34. The inlet check valve 56 closes and prevents the liquid from flowing back to the casing annulus 60. The liquid travels through the outlet check valve 58 and into the liquid string 40. During this process, gas is moving out of the power gas string 38 faster than the compressor 22 is replacing it. As a result, the power gas string pressure begins to drop. The power gas continues to displace liquids out of the chamber 34 and into the liquid string 40. When the power gas pressure declines to a calculated preset pressure, the shifting valve 46 closes the power gas string port and communicates the chamber with the annulus 60 of the casing 36. This occurs when the power gas pressure at the chamber declines to its lower level. The volume of gas taken out of the power gas string 38 so as to reduce the pressure to this lower level, while the compressor 22 is injecting gas into the power gas string 38, is the volume required to displace the liquid from the chamber 34 into the liquid string 40. This is the volume of gas to occupy the space previously occupied by the liquid. In this application, approximately 1,500 SCF of gas occupies one barrel of volume at downhole conditions (5,700 psi and 300 degrees F.). With the port of the power gas string 38 closed and the venting port open, liquid displacement from the chamber 34 stops and the outlet check valve 58 closes so as to trap the liquid in the liquid string 40.

Following this step, the venting and depressurizing of the chamber 34 to the casing annulus 60 occurs. When the pressure of the chamber 34 declines to the hydrostatic pressure created by the column of liquid in the casing annulus at the chamber intake 54, the inlet check valve 56 opens and the chamber 34 begins to fill with liquid. The chamber is now simultaneously being depressurized and filled with liquid. This process continues until (1) the chamber 34 is filled completely with liquid or (2) the shifting valve 46 closes the vent port and opens the port to the power gas string 38. The latter is controlled by the rate at which gas is being injected into the power gas string 38. Therefore, it is important that the time required to depressurize and refill the chamber 34 is the same as the time to raise the pressure in the power gas string 38 from its lower level to its higher level. The cycle then repeats itself.

Figure 3:
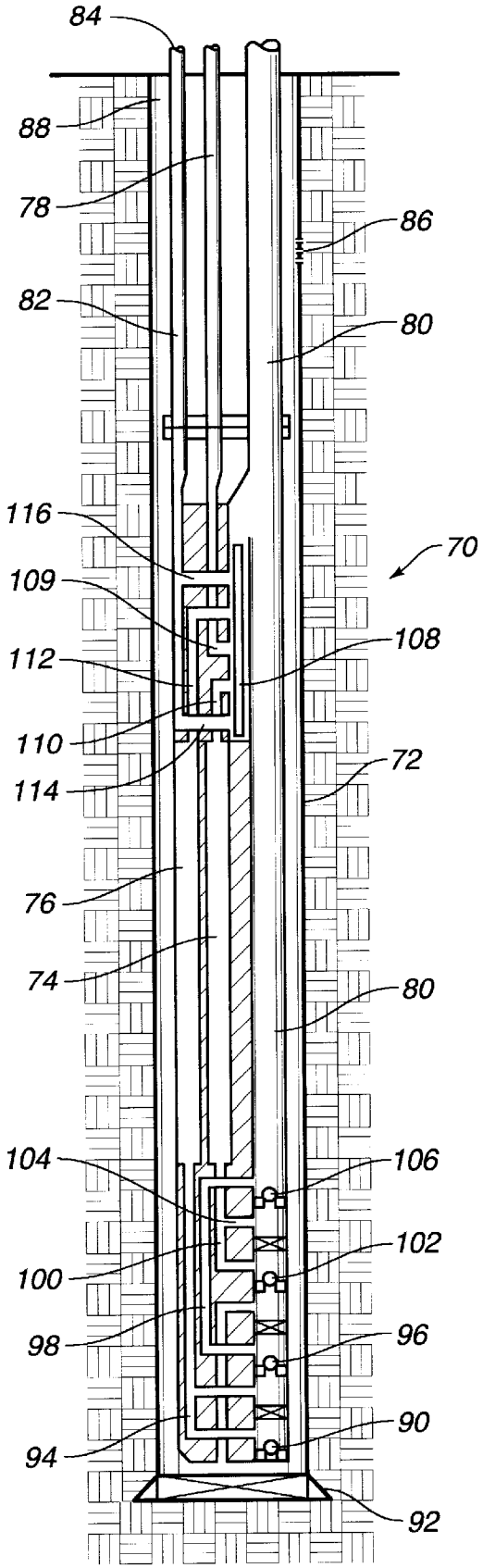
FIG. 3 is a cross-sectional view illustrating the preferred embodiment of the double chamber gas displaced chamber lift system in accordance with the teachings of the present invention.

FIG. 3 shows the preferred embodiment 70 of the artificial lift system of the present invention. Artificial lift system 70 is located in a well bore 72. In this embodiment 70 of the present invention, a first chamber 74 is positioned within the well bore 72 adjacent to a second chamber 76. The chambers 74 and 76 have approximately the same volume or capacity. The chambers 74 and 76 are arranged in side-by-side and parallel relationship. As can be seen, the top of chamber 74 is aligned in the same horizontal plane with the top of chamber 76. Similarly, the bottom of chamber 74 is aligned in the same horizontal plane with the bottom of chamber 76.

It has been found that this side-by-side relationship of the chambers 74 and 76 can be more easily installed within the well bore without undue mechanical manipulation or structural engineering. Furthermore, the positioning of the chambers 74 and 76 at approximately the same location within the well bore avoids any differences in the loading of the chambers 74 and 76 because of the head pressure within the well. The arrangement of the chambers 74 and 76 in the side-by-side spaced relationship facilitates the automatic and continual cycling of the artificial system without uneven liquid accumulation within the chambers.

As can be seen in FIG. 3, a power gas string 78 is arranged so as to be in valved communication with each of the chambers 74 and 76. The liquid string 80 also extends so as to be in valved communication with each of the chambers 74 and 76. A vent stack 82 is further connected in valved communication with the chambers 74 and 76. The outlet 84 of the vent stack 82 is located above the perforations 86 in the casing of the well bore 72. As such, the vent 82 is suitable for venting gas into the annulus 88 of the well bore. It is also possible that the vent stack 84 can be connected with the liquid string 80 so as to facilitate the movement of the liquid to the surface of the well. Still further and alternatively, the vent stack 82 can be connected to the compressor at the surface of the well so as to improve the efficiency of the compressor. Still further, and otherwise, the vent stack 82 can pass to the surface so that the gases received therefrom can be stored and reused.

Initially, a check valve 90 is provided adjacent to the bottom of the system 70 adjacent to the bottom packing 92. The inlet check valve 90 allows any fluids in the annulus 88 to pass through passageway 94 and into the interior of the second chamber 76. During the injection of pressurized gas into the second chamber 76, any liquids on the interior of the chamber 76 will pass through passageway 94 and exit into the liquid string 80 through the outlet check valve 96 and through passageway 98. Passageway 98 is connected to the liquid string 80. Similarly, liquids from the annulus 88 can enter the first chamber 74 through inlet passageway 100. Inlet passageway 100 leads to an inlet check valve 102. As such, liquids will pass from the annulus 88 through the check valve 102, through passageway 100, and into the interior of the first chamber 74. Upon the introduction of pressurized gas into the interior of the first chamber 74, the liquids will exit the chamber 74 through the passageway 104 and through the outlet check valve 106 into the interior of the liquid string 80.

Shifting valve 108 is provided so as to have a similar action to that described herein previously. Shifting valve 108 has two positions. When shifting valve 108 is in the first position, it connects passageway 109 with passageway 110 so as to cause the power gas string 78 to communicate with the chamber 74. In the same position, passageway 114 is blocked from passageway 10. As such, chamber 74 will not communicate with the vent stack 82. When the shifting valve 108 is in this first position, it connects passageway 112 with passageway 116 so as to allow the second chamber 76 to vent any pressurized gas through passageways 112 and 116 into the vent stack 82. In this position, passageway 109 is blocked from passageway 112. As a result, chamber 76 will not connect with the power gas string 78. When the shifting valve 108 is in this first position, power gas will displace any liquids in the chamber 74 into the liquid string 80. Chamber 76 will depressurize and allow any gases to flow therefrom into the vent stack 82. Simultaneously, chamber 76 will begin to be filled with liquid from the annulus 88.

When shifting valve 108 switches to a second position, the connections are reversed. In other words, chamber 74 will communicate with the vent stack 82 through passageways 110 and 114. Chamber 76 will communicate with the power gas string 78 through passageways 109 and 112. In this manner, the present invention is able to achieve simultaneous displacement of one chamber while the other chamber is being depressurized and refilled. It is believed that this double chamber configuration can lift twice as much liquid as a single chamber arrangement. Production capacity is not interfered with since at least one of the chambers 74 and 76 will be continuously receiving liquid from the annulus 88 through the respective inlets. This arrangement allows somewhat continuous cycling of the various components rather than the on/off arrangement of the simplified embodiment.

Within the concept of the present invention, it is to be noted that the shifting valve 108 can also move to another position, if so desired. Under certain circumstances, it may be desirable that the pressurized gas accumulate within the power gas line before being introduced into either of the chambers 74 and 76. As such, the shifting valve 108 can move to a third position in which pressurized gas flow is blocked from either of the chambers 74 and 76. In such an arrangement, the chambers 74 and 76 can simultaneously vent to the atmosphere and/or be filling with liquid from the annulus 88.

The artificial lift system of the present invention is particularly useful for restoring production in depleted high condensate yield sour gas wells. In particular, this system can be applied to Smackover wells. The present invention achieves flowing bottom hole pressures of approximately 600 p.s.i. at 13,000 feet with flowing wellhead pressures of 300 p.s.i. The configuration of the present invention employs an apparatus that can withstand bottom hole temperatures of greater than 300 degrees F. The present system can handle produced gas volumes of 3,000 MCFD. The present invention can achieve the production of liquid volumes exceeding 500 barrels per day. The present invention is suitable for operating in a very "gassy" high API oil gravity environment. Since the wells in which the present invention are intended to be used for producing in sour gas environments, the present invention minimizes the downhole parts. As a result, the present invention avoids the destructive effects of the corrosive environment into which it is placed. The downhole moving parts are wireline retrievable. The present invention can work with saturated brines having greater than 200,000 parts per million chlorides. The present invention is compatible with conventionally-sized production casing. Despite the fact the present invention can be used at very deep volumes, the present invention is cost competitive with other forms of lift. It is possible that the present invention can be utilized in depths of up to 25,000 feet and can lift higher volumes of up to 2,000 barrels per day. Unlike intermittent systems, the present invention pushes an entire line of liquid through the liquid string. As such, the transit time of individual "slugs" of liquid is avoided. The liquid string continuously allows the outflow of liquid therefrom. The ability to control and utilize high gas pressures allows for the necessary "brute" force so as to deliver the continuous string of liquid from the liquid string.

The foregoing disclosure and description of the invention is illustrative and explanatory thereof. Various changes in the details of the illustrated construction or in the steps of the described method can be made within the scope of the appended claims without departing from the true spirit of the invention. The present invention should only be limited by the following claims and their legal equivalents.

I claim:

1. An artificial lift system for use in a well bore comprising:

a first chamber having an inlet and an outlet;

a second chamber having an inlet and an outlet, said second chamber being arranged in side-by-side spaced and separate parallel relationship to said first chamber;

a power gas string in valved communication with said first chamber and said second chamber;

a liquid string in valved communication with said outlet of said first chamber and with said outlet of said second chamber;

a vent in valved communication with said first chamber and with said second chamber;

a compressor connected to said power gas string and adapted to pass a pressurized gas into said power gas string; and a valve connected to said power gas string and to said first and second chambers, said valve selectively and alternately allowing the pressurized gas to enter said first chamber and said second chamber so as to directly displace a liquid in said first chamber through said outlet of said first chamber and into said liquid string and to directly displace a liquid in said second chamber through said outlet of said second chamber and into said liquid string.

2. The system of claim 1, said liquid extending continuously along said liquid string from an uppermost of said outlets of said first and second chambers.

3. The system of claim 1, said first chamber having an approximately equal volume as said second chamber.

4. The system of claim 1, said first chamber having a top end aligned in a horizontal plane with a top of said second chamber, said first chamber having a bottom end aligned in a horizontal plane with a bottom of said second chamber.

5. The system of claim 1, said valve movable between a first position and a second position, said first position allowing pressurized gas into one of said first and second chambers while blocking pressurized gas from entering another of said first and second chambers, said second position allowing pressurized gas into said another of said first and second chambers while blocking pressurized gas from entering said one of said first and second chambers.

6. The system of claim 5, said valve adapted to close said vent relative to said one of said first and second chambers when said valve is moved to said first position, said valve adapted to close said vent relative to said another of said first and second chambers when said valve is moved to said second position.

7. The system of claim 1, said vent being interactive with said valve so as to allow gas to vent from one of said first and second chambers after the liquid has passed from said one of said first and second chambers, said vent being interactive with said valve so as to allow gas to vent from another of said first and second chambers after the liquid has passed from said another of said first and second chambers.

8. The system of claim 1, said compressor adapted to pass a pressurized gas of greater than 5,000 p.s.i. into said power gas string.

9. An artificial lift system for use in a well bore comprising:

a first chamber having an inlet and an outlet;

a second chamber having an inlet and an outlet, said second chamber being in spaced and separate side-by-side relationship to said first chamber, said first chamber having a top end aligned in a horizontal plane with a top of said second chamber, said first chamber having a bottom end aligned in a horizontal plane with a bottom of said second chamber;

a power gas string connected to said first and second chambers;

a liquid string connected to said outlet of said first chamber and to said outlet of said second chamber;

a vent connected to said first and second chambers;

a compressor connected to said power gas string and adapted to pass a pressurized gas into said power gas string; and a valve connected to said power gas string and to said vent, said valve adapted to selectively and alternately pass pressurized gas into said first and second chambers so as to directly displace liquid in said first and second chambers through the respective outlets and into said liquid string, said valve adapted to selectively and alternately vent gas from said first and second chambers after the liquid has passed into the liquid string.

10. The system of claim 9, said first and second chambers being in parallel relationship to each other, said first and second chambers having an approximately equal volume.

11. The system of claim 9, said liquid extending continuously along said liquid string from an uppermost of said outlets of said first and second chambers.

12. The system of claim 9, said valve being movable between a first position and a second position, said first position allowing pressurized gas into said first chamber while blocking pressurized gas from entering said second chamber, said second position allowing pressurized gas into said second chamber while blocking pressurized gas from entering said first chamber.

13. The system of claim 12, said valve adapted to close said vent relative to said first chamber when said valve is moved to said first position, said valve adapted to close said vent relative to said second chamber when said valve is moved to said second position.

14. A method of lifting a liquid from a well bore in which a first chamber and a second chamber are arranged in spaced and separate side-by-side relationship, a liquid string and a power gas string extend from the first and second chambers, each of the first and second chambers has an inlet which allows liquid from the well bore to enter the chambers and an outlet which allows liquid from the chamber to enter the liquid string, the method comprising:

passing pressurized gas through said power gas string into said first chamber so as to directly displace liquid from said first chamber into said liquid string;

blocking gas flow from entering said second chamber so as to allow liquid to accumulate in said second chamber;

venting gas from said first chamber after a desired period of time; and passing pressurized gas through said power gas string and into said second chamber and blocking the passing of pressurized gas into said first chamber so as to directly displace liquid from said second chamber and to enter said liquid string as a continuous liquid line through said liquid string.

15. The method of claim 14, further comprising:

venting the pressurized gas from the second chamber after a desired period of time.

16. The method of claim 14, said step of passing pressurized gas into said first chamber comprising:

passing pressurized gas of at least 5,000 p.s.i. into said first chamber while blocking the passing of pressurized gas into said second chamber.

17. The method of claim 14, further comprising:

installing said first and second chambers in said well bore in parallel relationship, said first and second chambers having approximately equal volumes.

* * * * *